US008584967B2

(12) United States Patent
Feriani et al.

(10) Patent No.: US 8,584,967 B2
(45) Date of Patent: Nov. 19, 2013

(54) WATERTIGHT FRAGRANCE DISPENSING DEVICE

(75) Inventors: Amir Feriani, Auvernier (CH); Christian Tache, Peseux (CH); Luciano Cravero, Cressier (CH)

(73) Assignee: EP Systems SA, Neuchatel (CH)

( * ) Notice: Subject to any disclaimer, the term of this patent is extended or adjusted under 35 U.S.C. 154(b) by 206 days.

(21) Appl. No.: 13/110,791

(22) Filed: May 18, 2011

(65) Prior Publication Data

US 2011/0290907 A1 Dec. 1, 2011

(30) Foreign Application Priority Data

May 18, 2010 (EP) ..... 10163165

(51) Int. Cl.
*B05B 1/08* (2006.01)

(52) U.S. Cl.
USPC ..... 239/102.1; 239/44

(58) Field of Classification Search
USPC ..... 239/102.1, 102.2, 34, 44, 45, 47, 53, 58
See application file for complete search history.

(56) References Cited

U.S. PATENT DOCUMENTS

| | | | | |
|---|---|---|---|---|
| 6,802,460 | B2 * | 10/2004 | Hess et al. | 239/306 |
| 6,969,008 | B2 * | 11/2005 | Helf et al. | 239/4 |
| 7,070,121 | B2 * | 7/2006 | Schramm et al. | 239/102.1 |
| 7,387,265 | B2 * | 6/2008 | Hess et al. | 239/102.2 |
| 8,006,918 | B2 * | 8/2011 | Mahoney, Iii et al. | 239/102.2 |
| 2003/0218077 | A1 * | 11/2003 | Boticki et al. | 239/102.1 |
| 2008/0164339 | A1 * | 7/2008 | Duru | 239/102.2 |
| 2009/0314853 | A1 | 12/2009 | Feriani et al. | |

FOREIGN PATENT DOCUMENTS

| | | | |
|---|---|---|---|
| EP | 1 129 741 | A2 | 9/2001 |
| EP | 2 130 611 | A1 | 12/2009 |
| EP | 08 157 455.0 | A1 | 12/2009 |
| WO | 2006/066671 | A1 | 6/2006 |

OTHER PUBLICATIONS

E-mail from received from third party Elson Silva regarding hydrology science dated Dec. 1, 2011.

* cited by examiner

*Primary Examiner* — Davis Hwu
(74) *Attorney, Agent, or Firm* — Griffin & Szipl, P.C.

(57) ABSTRACT

A watertight fragrance dispensing device for ejecting fragrance as a spray of droplets, the device including: a spray head for ejecting fragrance from the device; a liquid reservoir arranged to provide the fragrance to the spray head, wherein the reservoir includes a primary reservoir (31), a secondary reservoir (34), and a capillary liquid feed (33) connecting the liquid reservoir to the spray head, wherein the device further includes a bottom housing; and electronic control means arranged in the bottom housing for controlling the dispensing of fragrance from the device, wherein the secondary reservoir is disposed in the primary reservoir and is in direct contact with the capillary liquid feed, wherein the secondary reservoir is smaller than the primary reservoir and contains a unit dose of fragrance to be ejected from the device.

14 Claims, 8 Drawing Sheets

WATERTIGHT FRAGRANCE DISPENSING DEVICE

This application claims priority from European Patent Application No. 10 163 165.3, filed May 18, 2010, the entire disclosure of which is incorporated herein by reference.

FIELD OF THE INVENTION

The present invention relates to a droplet dispensing device, and more specifically to a watertight liquid droplet dispensing device for personal fragrances. Such droplet dispensing devices are also sometimes called aerosol generators, nebulizers, and the like. They normally contain a spray head having a nozzle body on a support part, in particular, a nozzle body of a liquid droplet dispensing device, which dispenses a liquid substance as a liquid droplet spray from the device through the nozzles of the nozzle body. They may further consist of an actuator based on a vibrating element, which generally causes the liquid to vibrate, to be accelerated and expelled as droplets. They may further consist of elements such as liquid space, liquid feed and fluid interface to a reservoir, a reservoir as well as electrical connections between the vibrating element and a corresponding electronic circuitry. Such liquid may be, for example, a perfume.

BACKGROUND OF THE INVENTION

Such nozzle bodies are sometimes called aperture plates, nozzle arrays, dosing aperture, orifice plate, vibratable membrane member, dosing aperture arrangement, aerosol generator, and the like. These terms are hence to be understood as being interchangeable throughout the present document.

In fact, such nozzle bodies and droplet dispensing devices are well known, for example, see the document EP 1 129 741 in the name of the present Applicant. This document describes a liquid droplet spray device having a top substrate formed of a main body and of a nozzle body. The nozzle body contains a nozzle array of liquid droplet outlet means allowing a liquid substance contained in the liquid droplet spray device to exit the device, in this case as a spray of droplets. The nozzle body is conventionally formed of a nozzle array.

In order to allow for an effortless transportation of liquid out of the reservoir into the nozzle body, a venting hole may be used to ensure correct pressure difference between the inside of the reservoir and the surrounding atmosphere. An example is shown in FIG. 1. A reservoir 3 contains liquid and is covered by a cap in which a venting hole 35 may be provided. A gasket (not shown) may be provided to ensure liquid tightness.

However, if the spray device is, for example, held in an upside down position, liquid may seep through the venting hole 35 shown in FIG. 1 causing leakage and inconvenience, such as unwelcome smell, etc.

Similar leakage can be caused by a change of temperature of the liquid, for example, because of hand holding the device, resulting in a change of volatility of the liquid. Another cause of leakage is increased pressure on the reservoir induced by a hand of a user or by change of atmosphere pressure, wherein the resulting deformation forces liquid to exit the reservoir, and the spray device, by way of the venting hole.

As can be understood from the above, it is thus important to provide a venting hole to ensure correct spraying, but a venting hole causes unwanted leakage of liquids to be sprayed. In room fragrance devices, this is generally not a major problem, because the device is generally positioned on a stable surface and in a stationary position.

However, in a personal fragrance device, for example, a perfume dispenser, such leakage is much more prominent, because the device can put in a pocket or a handbag, and thus may be in any position. Indeed, any perfume leaking out into a ladies handbag, for example, is of course to be avoided.

It is therefore desirable to provide a liquid droplet dispensing device for emitting perfume and the like that is watertight.

However, the design of such a watertight device is limited due to physical laws, in particular, Jurin's rule. Indeed, Jurin's rule defines the height that a liquid can reach when rising in a capillary tube. This rule states that the height of liquid in a capillary tube is inversely proportional to the diameter of the tube at the surface of the liquid only. This rule is as follows:

$$h = \frac{2\gamma\cos(\theta)}{r \cdot \rho \cdot g},$$

where:

h is the height of the liquid;

y is the surface tension of the liquid;

θ is the contact angle between the liquid and the wall of the tube;

ρ is the fluid density of the liquid;

r is the radius of the tube; and g is the gravitational acceleration.

The valid conditions for applying Jurin's rule are as follows: the diameter of the tube must be smaller than the capillary length, which typically is 2 mm for water at ambient temperature and pressure.

This means that such a liquid droplet dispensing device has design constraints resulting in a limited height and shape, because liquid can only rise over a limited distance by capillary action. Clearly, in the world of perfume, such constraints are very limiting.

The present invention addresses this contradictory aspect and provides a liquid droplet dispensing device that is watertight and that allows one to overcome the design constraints imposed by Jurin's rule.

SUMMARY OF THE INVENTION

The innovative dispensing device, in accordance with the present invention, is defined in accordance with several illustrative embodiments. For example, in accordance with a first embodiment of the present invention, a watertight fragrance dispensing device for ejecting a fragrance as a spray of droplets is provided, wherein the device includes: (a) a spray head (1) for ejecting fragrance from the device, (b) a liquid reservoir (3) arranged to provide the fragrance to the spray head, wherein the reservoir includes (i) a primary reservoir (31), (ii) a secondary reservoir (34), and (iii) a capillary liquid feed (33) connecting the liquid reservoir to the spray head (1), (c) a bottom housing (2), and (d) electronic control means (23) arranged in the bottom housing for controlling the dispensing of fragrance from the device, wherein the secondary reservoir (34) is disposed in the primary reservoir (31) and is in direct contact with the capillary liquid feed (33), wherein the secondary reservoir (34) is smaller than the primary reservoir and contains a unit dose of fragrance to be ejected from the device. In accordance with a second embodiment of the present invention, the first embodiment is modified so that the watertight fragrance dispensing device further comprises a capillary valve means (18, 19) for controlling and feeding liquid from the reservoir (3) to the spray head (1). In accordance with a third embodiment of the present invention, the first embodiment or the second embodiment is further modified so that the reservoir (3) is substantially rectangular-shaped with its shorter sides being shaped such that they are rounded and thin such that the reservoir is placed horizontally on its larger side.

In accordance with a fourth embodiment of the present invention, the first embodiment, the second embodiment, and the third embodiment are further modifies so that the spray head (1) further comprises a spray head body (12), wherein the spray head body (12) comprises a space body (17) having a compression chamber (17*a*) for containing liquid to be expelled, a nozzle body (16) having liquid outlet means through which the liquid is to be expelled, and a vibrating element (112) arranged to actuate liquid in the compression chamber (17*a*) such that the liquid undergoes a vibration and contacts the liquid outlet means thereby exiting the device as a liquid droplet spray. In accordance with a fifth embodiment of the present invention, the first embodiment, the second embodiment, the third embodiment, and the fourth embodiment are further modified so that the watertight fragrance dispensing device further includes an actuating member (112) arranged between the vibrating element (111) and the space body (17) for transmitting ultrasound energy generated by vibrations of the vibrating element (111) to liquid contained in the compression chamber (17*a*).

In accordance with a sixth embodiment of the present invention, the first embodiment, the second embodiment, the third embodiment, the fourth, and the fifth embodiment are further modified so that the secondary reservoir (34) contains a unit dose of liquid to be expelled. In accordance with a seventh embodiment of the present invention, the first embodiment, the second embodiment, the third embodiment, the fourth embodiment, the fifth embodiment, and the sixth embodiment are further modified so that the secondary reservoir (34) is a wick.

In accordance with an eighth embodiment of the present invention, the fourth embodiment is further modified so that the spray head (1) further comprises a covering element (15) for covering the nozzle body (16) so as to prevent leakage of liquid from the watertight fragrance dispensing device, wherein the covering element (15) is arranged over the nozzle body (16) and has a central opening aligning with the nozzles of the nozzle body (16). In accordance with a ninth embodiment of the present invention, the eighth embodiment is further modified so that the covering element (15) comprises a buffer chamber (15*a*) for receiving any liquid leaking out of the nozzle body (16). In accordance with a tenth embodiment of the present invention, the fourth embodiment is further modified so that the spray head (1) further comprises a nozzle mask (14) that can be moved between a position to cover the nozzle body (16) so as to protect its nozzles and a position to uncover the nozzles of the nozzle body (16).

In accordance with an eleventh embodiment of the present invention, the first embodiment, the second embodiment, the third embodiment, the fourth embodiment, the fifth embodiment, the sixth embodiment, the seventh embodiment, the eighth embodiment, the ninth embodiment, and the tenth embodiment are further modified so that the electronic control means (23) is pulse operated. In accordance with a twelfth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment, and the eleventh embodiment are further modified so that the watertight fragrance dispensing device further comprises a battery (24) to power the electronic control means (23).

Thanks to the construction of the innovative dispensing device, according to the present invention, an efficient device fulfilling this objective may be obtained in a relatively simple and inexpensive manner.

BRIEF DESCRIPTION OF THE DRAWINGS

Other features and advantages of the dispensing device according to the present invention will become clear from reading the following description, which is given solely by way of a non-limitative example, thereby referring to the attached drawings in which.

DETAILED DESCRIPTION OF THE INVENTION

Figure 1:
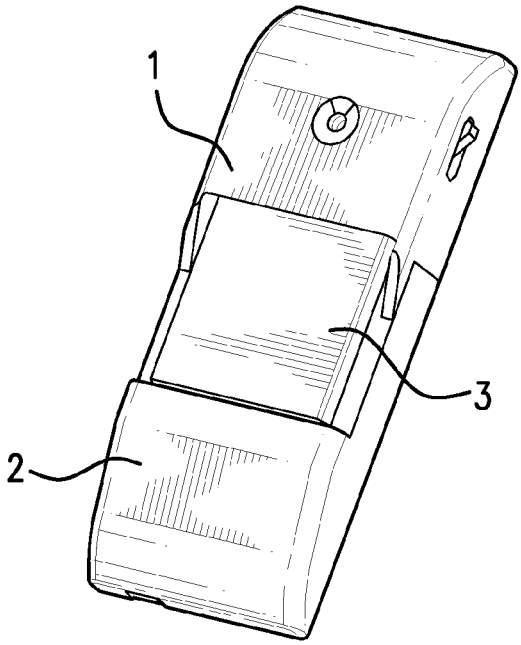
FIG. 1 shows an example of a dispensing device according to the present invention.
Figure 1A:
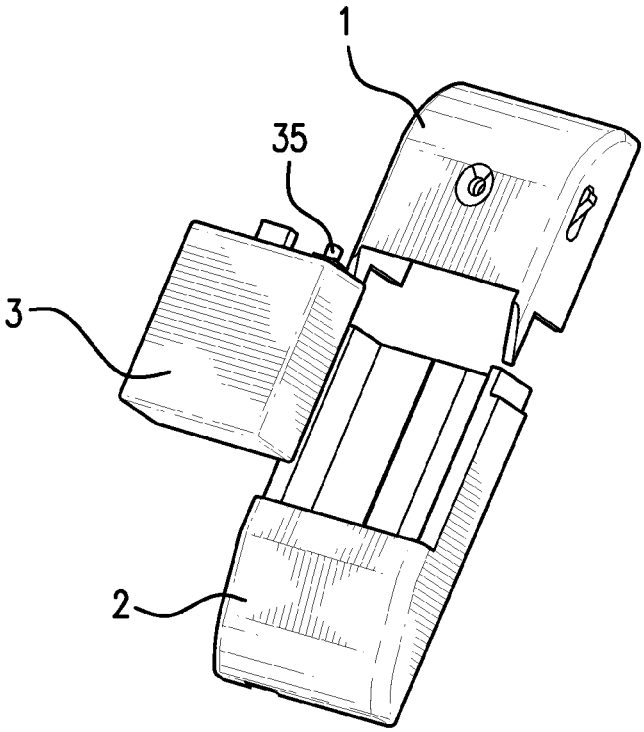
FIG. 1A shows an exploded design of the dispensing device according to the present invention.

The watertight liquid droplet dispensing device, according to the present invention, allows for ejecting a fragrance as a spray of droplets. As shown in FIGS. 1 and 4A, the dispensing device comprises a spray head 1 for ejecting fragrance from the device, a liquid reservoir 3 arranged to provide fragrance to the spray head 1, and a bottom housing 2 for containing electronic control means 23 for controlling the dispensing of fragrance from the device.

The liquid reservoir 3 comprises a primary reservoir 31, a secondary reservoir 34, and a capillary liquid feed 33 connecting liquid reservoir 3 to spray head 1. The secondary reservoir 34 is disposed in the primary reservoir 31 and is in direct contact with capillary liquid feed 33. Furthermore, secondary reservoir 34 is smaller than primary reservoir 31 and preferably contains a unit dose of fragrance to be ejected from the device.

A preferred embodiment will now be described. As can be seen in FIGS. 1, 1A, 5 and 5A, the liquid droplet dispensing device comprises a spray head 1, a bottom housing 2 and a reservoir 3. Reservoir 3 is presented as a replaceable refill. In fact, once the reservoir is empty, a new one may be inserted.

Figure 2:
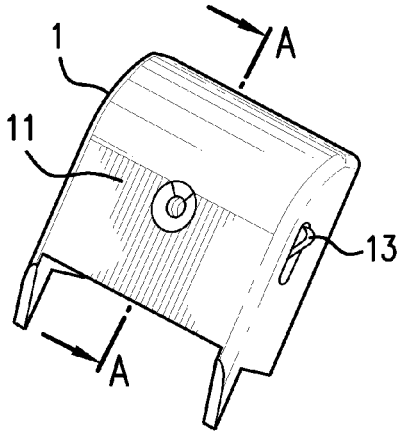
FIG. 2 shows an example of a leak-proof spray head of the dispensing device according to the present invention.
Figure 2A:
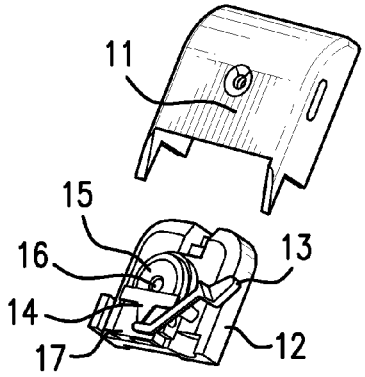
FIG. 2A shows an exploded design of the leak-proof spray head of the dispensing device according to the present invention.
Figure 2B:
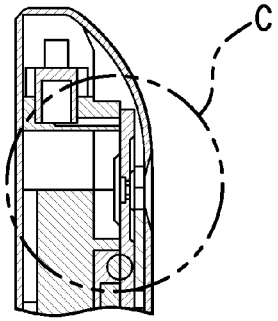
FIG. 2B shows a cross section of the leak-proof spray head of the dispensing device according to the present invention.

FIG. 2 shows, in more detail, an example of spray head 1. As shown, spray head 1 comprises a cap housing 11, a spray head body 12, a lever 13, a nozzle mask 14, a covering element 15, a nozzle body 16, a space body 17, a valve axis 18, a valve body 19, an actuator membrane 111 and a vibrating element 112. Spray head body 12 may be located in the way as disclosed, for example, in the afore-mentioned document EP 1 129 741 in the name of the present Applicant. Thus, nozzle body 16 contains a perforated membrane plate. The perforations are, in fact, nozzle outlet means through which droplets of fragrance are to be expelled. Vibrating element 112, for example, a piezoelectric element, acts on actuator plate 111, which itself acts on liquid contained in a space, or compression chamber 17*a*, provided in space body 17 proximate to nozzle body 16. Liquid is supplied from reservoir 3 to the space. In a manner known in the art, when vibrating element 112 is actuated, the ultrasound energy generated by the vibrating element is transmitted to the liquid causing it to undergo vibrations, which results in the liquid being pushed towards and through the outlet means of nozzle body 16 as a spray of droplets.

Vibrating element 112 may act directly on spray body 12 to transmit ultrasound energy to the liquid contained in space 17*a*, or it may act indirectly thereon. In such a case, and as shown in the present embodiment, an actuating member 111 may be provided between vibrating element 112 and the bottom surface of spray body 17. As such, when vibrating element 112 is activated, the ultrasound energy generated by vibrating element 112 is transmitted to actuating member 111 and then to liquid present in the space (i.e., compression chamber) of space body 17, thus causing the liquid to undergo vibrations and to be expelled as a spray of droplets. Such specific arrangement is described in detail in co-pending application EP 08 157 455.0 in the name of the present Applicant.

In order to protect the nozzle outlet means of nozzle body 16, a nozzle mask 14 may be provided. This may be a simple plate that can be moved from a first position uncovering the nozzle body, to a second position covering and protecting the nozzle body, for example from dust or sharp objects. Lever 13 is connected to nozzle mask 14 in a suitable manner to allow for this movement. In an alternative, nozzle mask 14 may be provided with a gasket, or the like, to ensure water tightness of the nozzle outlet means.

Figure 6:
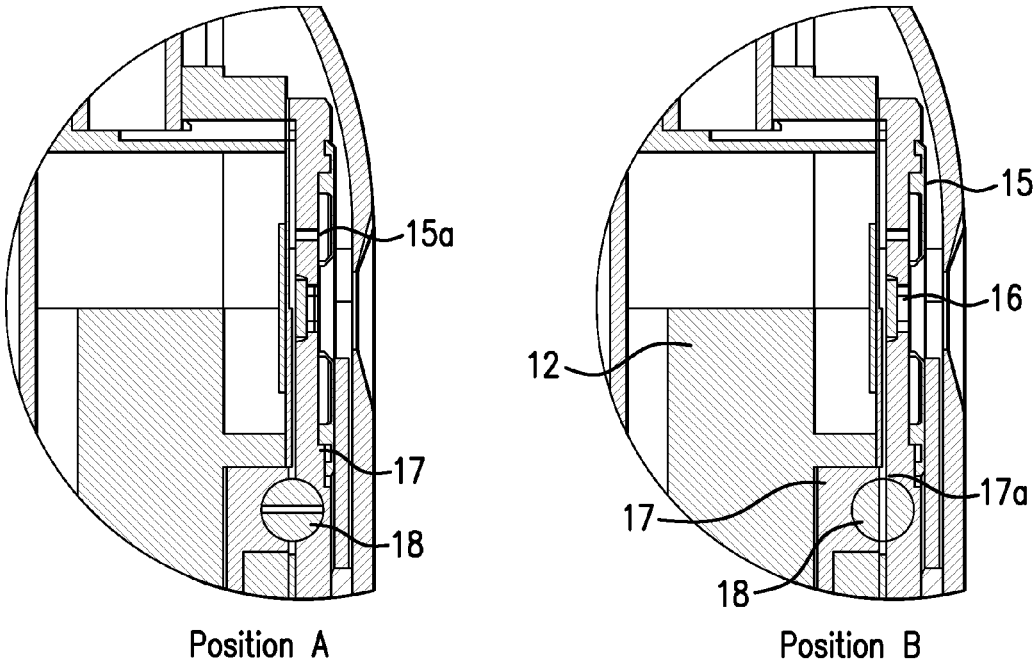
FIG. 6 shows a cross section of a capillary valve for the dispensing device according to the present invention.

A capillary liquid feed 33, for example, a mesh or a capillary channel, may be provided connecting reservoir 3 to spray head body 12. Liquid access to the compression chamber 17*a* may be controlled by a valve means, comprising valve axis 18 and valve body 19, located in the capillary channel. The valve means is dimensioned to allow for a sufficient and continuous capillary feed fluid flow and its opening and closing can be controlled in a mechanical or electronic manner. As an example, the valve means may allow for a liquid flow of between 20 and 40 μl/s. When the valve means is closed, there is no fluid communication between reservoir 3 and spray body 12, thus rendering the system watertight, even in changing atmospheric conditions such as in an airplane. FIG. 6 shows an example of the valve means in the open and closed position, allowing/preventing respectively liquid to flow from reservoir 3 to spray head 1.

Furthermore, in order to ensure that any liquid already present in the spray body will not leak out, a liquid retention zone may be provided in spray head body 12. In fact, due to temperature changes, for example, caused by a hand holding the spray device, any liquid present in space 17*a* of spray body 17 might leak out through the outlet means, because the temperature change may change the pressure of the liquid.

Figure 2C:
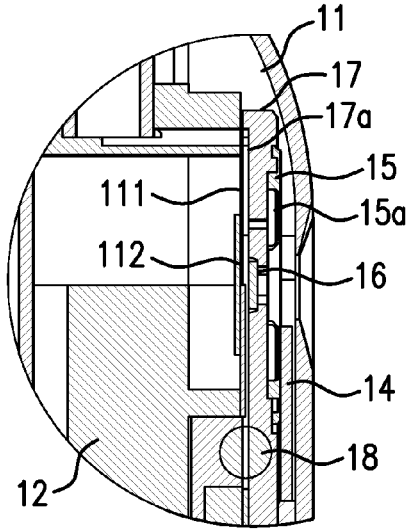
FIG. 2C shows details of the cross section of the leak-proof spray head of the dispensing device according to the present invention.
Figure 2D:
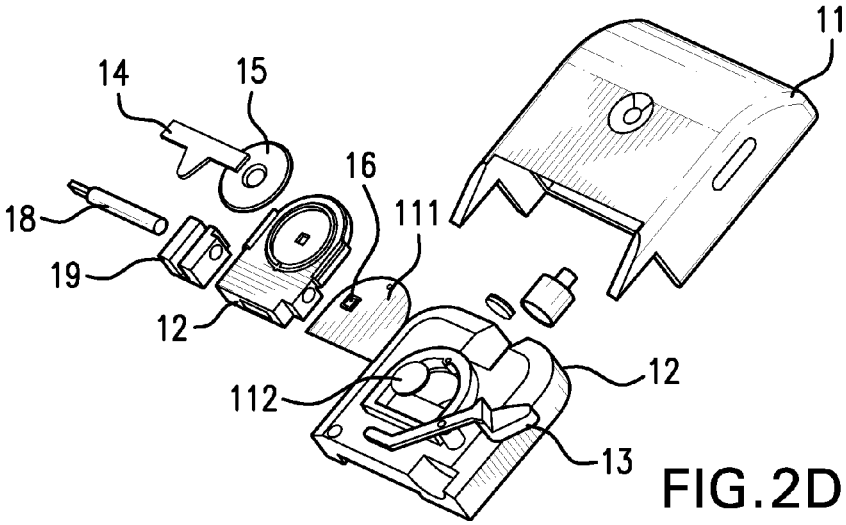
FIG. 2D shows, in detail, an exploded design of the leak proof spray head of the dispensing device according to the present invention.

In this respect, a covering element 15 is provided on top of nozzle body 16 and has a centrally arranged through-hole for alignment with the outlet means of nozzle body 16 to allow liquid to be ejected from the device. As can be seen in FIG. 2*c*, covering element 15 contains an internal buffer zone 15*a*, which constitutes a liquid high-retention zone. This buffer zone 15*a* is arranged to receive any liquid that may leak out of space body 17 through the outlet means of nozzle body 16.

Buffer zone 15 is dimensioned and configured such that it retains liquid by way of capillary action, i.e. any liquid that enters into buffer zone 15 flows in through capillary action, and will be retained therein by the capillary force.

Figure 3:
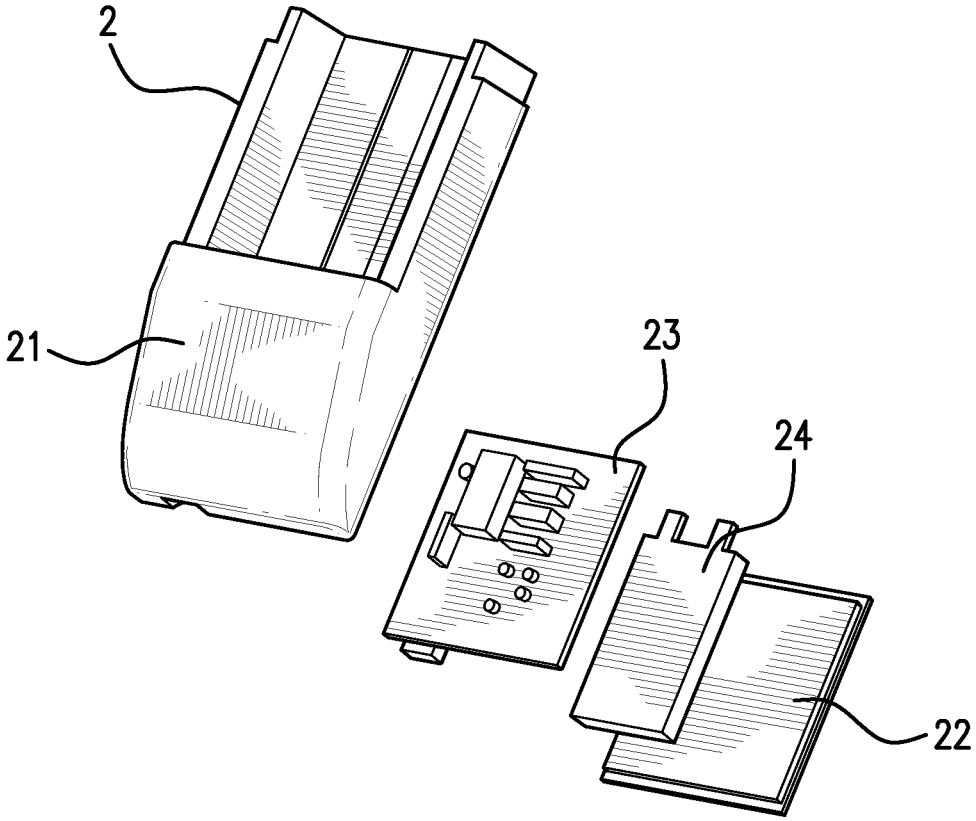
FIG. 3 shows an exploded design of a bottom housing of the dispensing device according to the present invention.

FIG. 3 shows an example of bottom housing 2. Bottom housing 2 comprises a bottom casing 21, a bottom casing cover 22, electronic control means 23 and a battery 24 for supplying power to electronic control means 23.

Bottom casing 21 is designed and shaped such that the spray device is placed horizontally when not in use, and not upright, for example, on a bottom edge. Indeed, by having a thin edge, the spray device cannot be placed upright, because it will fall. This arrangement is advantageous in that by placing the spray device horizontally, the secondary reservoir 34 can be easily filled with liquid from main reservoir 31, as will be explained in more detail later.

Battery 24 is dimensioned depending on the size of reservoir 3 and of the general design of the spray device. The larger the battery, the more liquid can be sprayed, but the heavier the device.

Electronic control means 23 is programmed to allow for sequenced spraying of fragrances from the spray device. It is possible to program the electronic control means such that the ejected spray can be controlled as a function of the used fragrance, i.e., of the liquid characteristics and features. In this example, the electronic control means 23 are programmed to eject the spray as a fine spray of droplets leaving a more or less "dry" film on a sprayed surface, such as the skin of a user of the device. Indeed, when spraying too much, the sprayed surface remains wet for a certain period of time. This is considered unpleasant for many users, in particular for certain surfaces, such as the neck. If the neck remains wet for a while after spraying, a user may have the sentiment that the spray may drip down lower, and that she or he smells too strong. Conventional mechanical spray devices do not allow for such electronic control, and thus have a tendency to spray too much liquid in a single spray release.

Figure 7:
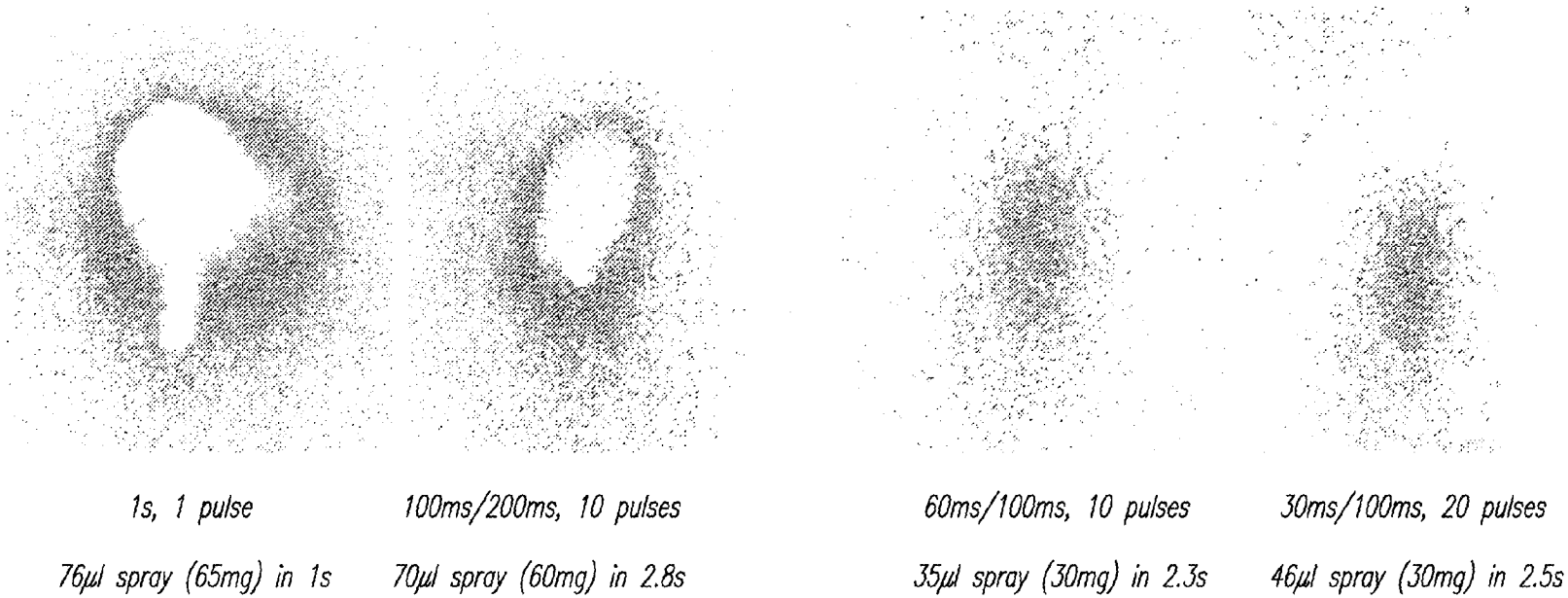
FIG. 7 shows a spray pattern with different pulse actuation sequences for a dispensing device according to the present invention.

Electronic control means 23 is configured such that the amount of released liquid may be regulated, without, however, changing the sizes of ejected droplets or the flow of droplets. In this way, a user can avoid the wetting problem mentioned above. Several examples of different kinds of ejected sprays are shown in FIG. 7. As shown from left to right in FIG. 7, an amount of 75 μl was sprayed for a period of 1 s, then 70 μl for 2.8 s, 35 μl for 2.3 s and 46 μl for 2.5 s. Clearly, in this example the impact on the sprayed surface can thus be controlled by varying the duration and the amount of liquid released in a spray sequence. Preferably, a pulsed operation of the electronic control means may be used to save energy, which is important when using a battery-powered device.

Figure 7A:
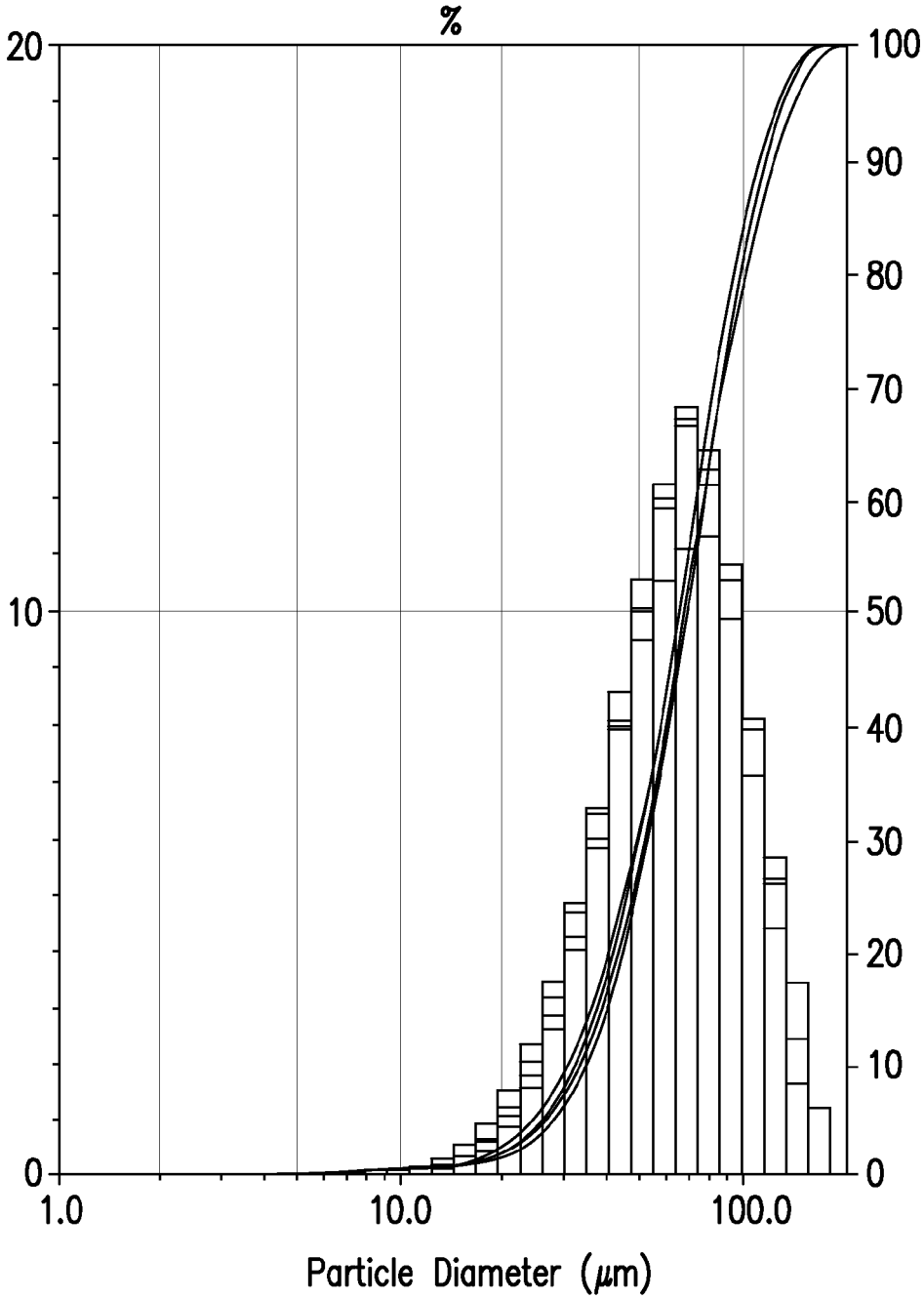
FIG. 7A shows a droplet size distribution with different pulse actuation sequences for the dispensing device according to the present invention.

As can be seen from FIG. 7A, these different actuations do not have an impact on the droplet size, because as shown the droplet distributions for all four examples shown in FIG. 7 overlap. As can be understood from this, the different activation parameters do not influence droplet size or the flow, which allows the system to respect the Volatile Organic Components (VOC) norm.

Figure 4:
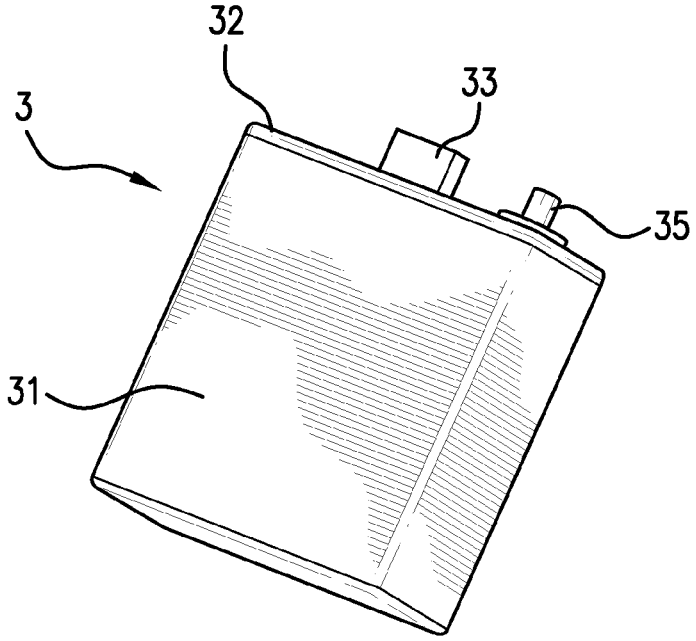
FIG. 4 shows an example of a leak proof refill of the dispensing device according to the present invention.
Figure 4A:
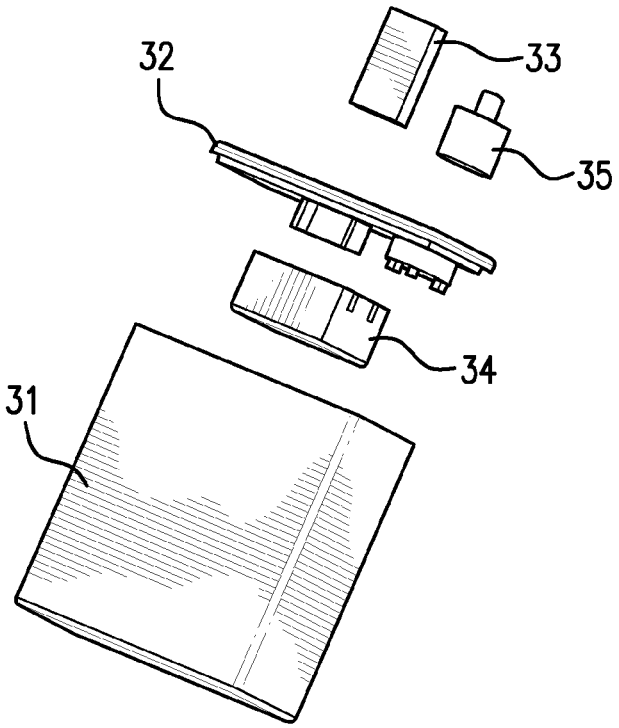
FIG. 4A shows an exploded design of the leak proof refill of the dispensing device according to the present invention.
Figure 5:
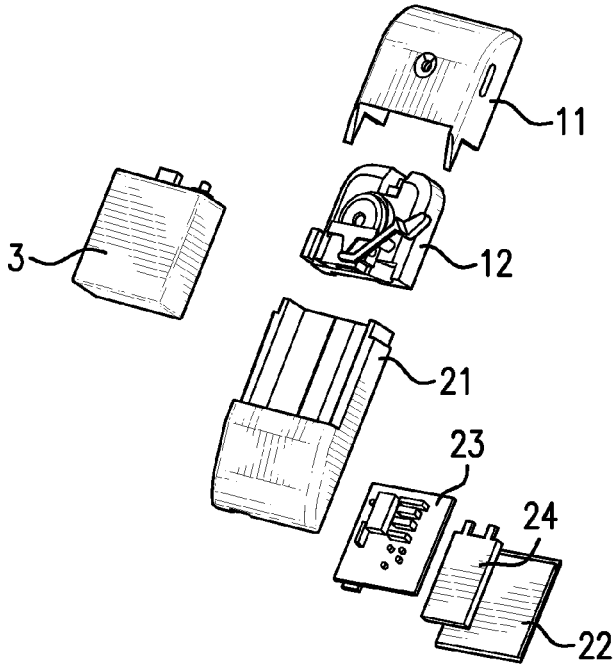
FIG. 5 shows an exploded design of the dispensing device according to the present invention.
Figure 5A:
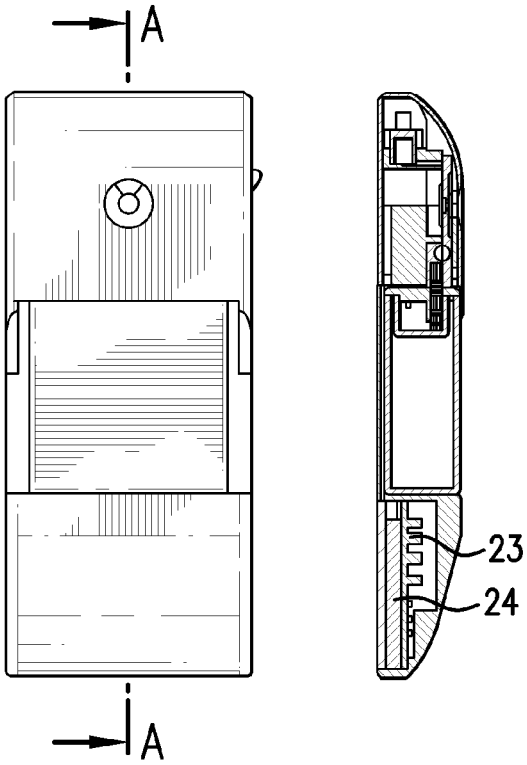
FIG. 5A shows a cross section of the dispensing device according to the present invention.

FIGS. 4 and 4*a* show an example of reservoir 3. Preferably, reservoir 3 is a disposable refill and can be easily fitted in, and removed from, the spray device. It may contain, for example, between 2 ml and 150 ml of liquid. As can be seen, reservoir 3 has a main, or primary reservoir 31, a reservoir cap 32 for covering and sealing the reservoir, a priming wick 33, a secondary reservoir 34 and an air valve 35.

Air valve 35 is provided to equalize the pressure in reservoir 3 with the outer pressure. However, air valve 35 may ensure liquid tightness up to a pressure of 600 mbar.

Reservoir 3 is designed, similar to bottom housing 2, to ensure a horizontal positioning of the spray device, and of the reservoir, so that primary reservoir 31 will instantly fill secondary reservoir 34. Secondary reservoir 34 may be a unit dose reservoir, containing sufficient liquid, for example, between 0.1 ml and 0.6 ml, for an ejection upon an activation of the device. It may also be a wick, or simply a plastic capillary tube, facilitating transportation of liquid from the reservoir to the spray head. Secondary reservoir 34 thus acts not only as a buffer reservoir, but also as a capillary transportation facilitator.

Thanks to this secondary reservoir, the maximum height restraint imposed by Jurin's rule explained above can be overcome. Indeed, as explained, in order to prime the liquid, i.e., allowing the liquid to move from primary reservoir 31 to spray head 12, a maximum height of the capillary channel has to be respected to ensure flowing of liquid.

According to the present invention, by providing secondary reservoir 34, which always fills up with liquid from primary reservoir 31, once the reservoir and/or spray device is positioned horizontally, primary reservoir 31 can be designed to have a height much larger than permitted by Jurin's rule.

Having described now the preferred embodiments of this invention, it will be apparent to one of skill in the art that other embodiments incorporating its concept may be used. It is felt, therefore, that this invention should not be limited to the disclosed embodiments, but rather should be limited only by the scope of the appended claims.

The invention claimed is:

1. A watertight fragrance dispensing device for ejecting a liquid fragrance as a spray of droplets, wherein the device comprises:

(a) a spray head for ejecting liquid fragrance from the fragrance dispensing device;

(b) a liquid reservoir arranged to provide liquid fragrance to the spray head, wherein the liquid reservoir comprises i. a primary reservoir;

ii. a secondary reservoir; and iii. a capillary liquid feed connecting the liquid reservoir to the spray head;

(c) a bottom housing; and (d) electronic control means arranged in the bottom housing and operably connected to control dispensing of liquid fragrance from the fragrance dispensing device, wherein the secondary reservoir is disposed in the primary reservoir and the secondary reservoir is in direct contact with the capillary liquid feed, wherein the primary reservoir and the secondary reservoir contain liquid fragrance and the liquid fragrance is moveable from the primary reservoir to the secondary reservoir, wherein the secondary reservoir is smaller than the primary reservoir and contains a unit dose of liquid fragrance to be ejected from the fragrance dispensing device, wherein the unit dose of liquid fragrance corresponds to an amount of liquid fragrance to be ejected upon activation of the device.

2. A watertight fragrance dispensing device according to claim 1, further comprising:

(e) a capillary valve means for controlling and feeding liquid fragrance from the liquid reservoir to the spray head.

3. A watertight fragrance dispensing device according to claim 1, wherein said liquid reservoir is substantially rectangular-shaped so as to have shorter sides and a larger side, wherein the shorter sides of said liquid reservoir are shaped so that the shorter sides are rounded and thin so that said liquid reservoir is placed horizontally on the larger side.

4. A watertight fragrance dispensing device according to claim 1, wherein said spray head comprises a spray head body, wherein said spray head body comprises i. a space body having a compression chamber for containing liquid fragrance to be expelled;

ii. a nozzle body having liquid outlet means through which said liquid fragrance is to be expelled; and iii. a vibrating element arranged to actuate liquid fragrance in said compression chamber so that the liquid fragrance undergoes a vibration and contacts the liquid outlet means thereby exiting said fragrance dispensing device as a liquid droplet spray.

5. A watertight fragrance dispensing device according to claim 4, further comprising (e) an actuating member arranged between said vibrating element and said space body for transmitting ultrasound energy generated by vibrations of said vibrating element to liquid fragrance contained in said compression chamber.

6. A watertight fragrance dispensing device according to claim 1, wherein said secondary reservoir is a wick.

7. A watertight fragrance dispensing device according to claim 4, wherein said spray head further comprises a covering element for covering said nozzle body so as to prevent leakage of liquid fragrance from said watertight fragrance dispensing device, wherein the covering element is arranged over said nozzle body and has a central opening aligning with nozzles of the liquid outlet means of said nozzle body.

8. A watertight fragrance dispensing device according to claim 7, wherein said covering element comprises a buffer chamber for receiving any liquid fragrance leaking out of said nozzle body.

9. A watertight fragrance dispensing device according to claim 4, wherein said spray head further comprises a nozzle mask that is moveable between a first position to cover said nozzle body so as to protect nozzles of said nozzle body and a second position to uncover the nozzles of said nozzle body.

10. A watertight fragrance dispensing device according to claim 1, wherein said electronic control means is pulse operated.

11. A watertight fragrance dispensing device according to claim 1, further comprising:

(e) a battery operably connected to power said electronic control means.

12. A watertight fragrance dispensing device according to claim 2, wherein said liquid reservoir is substantially rectangular-shaped so as to have shorter sides and a larger side, wherein the shorter sides of said liquid reservoir are shaped so that the shorter sides are rounded and thin so that said liquid reservoir is placed horizontally on the larger side.

13. A watertight fragrance dispensing device according to claim 2, wherein said spray head comprises a spray head body, wherein said spray head body comprises i. a space body having a compression chamber for containing liquid fragrance to be expelled;

ii. a nozzle body having liquid outlet means through which said liquid fragrance is to be expelled; and iii. a vibrating element arranged to actuate liquid fragrance in said compression chamber so that the liquid fragrance undergoes a vibration and contacts the liquid outlet means thereby exiting said fragrance dispensing device as a liquid droplet spray.

14. A watertight fragrance dispensing device according to claim 3, wherein said spray head comprises a spray head body, wherein said spray head body comprises i. a space body having a compression chamber for containing liquid fragrance to be expelled;

ii. a nozzle body having liquid outlet means through which said liquid fragrance is to be expelled; and iii. a vibrating element arranged to actuate liquid fragrance in said compression chamber so that the liquid fragrance undergoes a vibration and contacts the liquid outlet means thereby exiting said fragrance dispensing device as a liquid droplet spray.

* * * * *